US008028941B2

(12) United States Patent
Iwashige

(10) Patent No.: US 8,028,941 B2
(45) Date of Patent: Oct. 4, 2011

(54) PULPER FOR PULVERIZING AND SUSPENDING PAPER STOCK

(75) Inventor: Naoyuki Iwashige, Soka (JP)

(73) Assignee: Voith Paper Patent GmbH, Heidenhelm (DE)

( * ) Notice: Subject to any disclaimer, the term of this patent is extended or adjusted under 35 U.S.C. 154(b) by 1007 days.

(21) Appl. No.: 11/422,194

(22) Filed: Jun. 5, 2006

(65) Prior Publication Data

US 2006/0273208 A1 Dec. 7, 2006

(30) Foreign Application Priority Data

Jun. 7, 2005 (DE) ..... 10 2005 026 108

(51) Int. Cl.
*B02C 19/00* (2006.01)

(52) U.S. Cl. ..... 241/46.17; 241/21; 241/69

(58) Field of Classification Search ..... 241/21, 241/46.17, 69
See application file for complete search history.

(56) References Cited

U.S. PATENT DOCUMENTS 3,043,526 A * 7/1962 Cowles ..... 241/46.17

FOREIGN PATENT DOCUMENTS

| | | |
|---|---|---|
| DE | 3224705 | 1/1984 |
| DE | 3429514 | 2/1986 |
| DE | 3638993 | 7/1997 |
| DE | 9701129 | 7/1997 |

* cited by examiner

*Primary Examiner* — Faye Francis
(74) *Attorney, Agent, or Firm* — Greenblum & Bernstein, P.L.C.

(57) ABSTRACT

A pulper to pulverize and suspend paper stock. The pulper includes a container open at the top with a cylindrical side wall and a driven rotor that is arranged in an off-center manner to the center of the container. The base of the container can be inclined toward the side wall.

18 Claims, 1 Drawing Sheet

PULPER FOR PULVERIZING AND SUSPENDING PAPER STOCK

CROSS-REFERENCE TO RELATED APPLICATIONS

The present application claims priority under 35 U.S.C. §119 of German Patent Application No. 10 2005 026 108.6, filed on Jun. 7, 2005, the disclosure of which is expressly incorporated by reference herein in its entirety.

BACKGROUND OF THE INVENTION

1. Field of the Invention

The invention relates to a pulper for pulverizing and suspending paper stock and, more particularly, a pulper having a container which is configured to mix the paper stock with water, and pulverize and suspend the paper stock so as to form a suspension containing paper stock.

2. Discussion of Background Information

Pulpers are used mainly to put air-dry cellulose material or recovered paper into suspension. A pulper includes a container for the suspension of the paper stock, as well as a rotor (e.g., mixing and pulverizing) and, in many cases, a wire in the base area through which the suspension can be pumped off. In use, the charged material, typically in large pieces, webs or pressed bales, is forcefully mixed with water in the pulper by use of the mixing and pulverizing rotor.

A cylindrical container standing vertically with a rotor in the base area has established itself as the standard type for a pulper. In the container, water and the stock to be slushed are added from above and a funnel flow is generated in the suspension with the aid of the rotor. The suspension is suctioned downward by the rotor, in the central area, and is pressed radially outward in the base area, from which a rotational flow results.

Flow measures are also known to control the rotational flow. For example, the circumferential flow is slowed through corresponding flow installations (baffle plates) on the container wall, since it makes only a slight contribution to the slushing. In contrast, supporting the actual rotation, i.e., the repeated transport of the stock to be slushed into the rotor area brings about an improvement of the slushing effect. The aim is also to draw the freshly charged stock into the suspension as quickly as possible. For these reasons a great deal of development has already been carried out on the rotors and containers of the pulpers.

Attempts have been made to optimize the pulpers to achieve a quick slushing that is economical in terms of power. For example, it has been proposed in DE 197 01 129 A1 to design the container of the pulper in an angular manner to improve the stock intake. The asymmetrical arrangement of the rotor was intended to provide another improvement. However, this pulper has not been widely used.

Another attempt to improve pulpers is shown in DE 36 38 993 C2. In this attempt to improve the pulper, the flow of the suspension is generated with the aid of a laterally mounted rotor. The oblique position of the rotor axis also has been carried out, e.g., with a pulper shown in DE 32 24 705 C2, in which a rotor built relatively high has an acute angle to the vertical axis.

To improve the rotation, unconventional approaches have also been taken, such as, e.g., in DE 34 29 514 C2. According to DE 34 29 514 C2, a plurality of complex rotors are provided within the same pulper container.

SUMMARY OF THE INVENTION

The invention improves the known pulpers without significant additional expenses. In particular, the pulper of the present invention improves the intake of the material and more specifically, slushes the suspension more quickly and/or more cost-effectively.

The pulper of the present invention pulverizes and suspends paper stock with a container open at the top. A driven rotor is located on the base of the container, and is arranged in an off-center manner to the center of the container.

By using the present invention, it has been proven that a quicker intake of the charged paper stock and an improvement of the rotation are possible through the shape of the container. The entire slushing process runs more quickly, which causes a better machine utilization and an energy savings. The improved slushing effect can be ascertained through the quicker decrease of the fiber bundle content in the fibrous suspension.

In aspects of the invention, a pulper for pulverizing and suspending paper stock comprises a container having an open top and a driven rotor located on a base of the container such that a centerline of the rotor is offset from a centerline of the container. The base of the container rises towards a side wall of the container at an angle.

In embodiments of the invention, the centerline of the rotor is vertical. The container has an essentially cylindrical side wall, the centerline of which is perpendicular to the base. At least one flow barrier is installed on the essentially cylindrical side wall of the container. The at least one flow barrier extends into the container with a radial projection that has at least 10% of a diameter of the container. In further embodiments, the at least one flow barrier extends into the container with a radial projection of at least approximately 20% of the diameter of the container.

In embodiments, the at least one flow barrier is located in a 180° sector of the container that is furthest removed from the rotor. In further embodiments, the at least one flow barrier is located at a point of the container furthest removed from the rotor. The at least one flow barrier is only one flow barrier. In further embodiments, the at least one flow barrier is two flow barriers. The at least one flow barrier comprises a vertical angle profile which has sides connected to the side wall of the container.

A flat annular wire is arranged horizontally and concentrically with the rotor and located in the base of the container. A chamber for receiving and removing the suspension formed in the container is located under the wire. A diameter of the rotor is between approximately 20 and 40% of a diameter of the container. The ratio between total height and diameter of the container is between approximately 0.8 and 1.2.

In further embodiments, starting from an area of the rotor, the base rises towards the side wall at a base angle that is between approximately 15° and 60°. The base angle is between approximately 25° and 35°. The container is configured to mix paper stock with water, and pulverize and suspend the paper stock so that a suspension containing paper stock is formed. The rotor is configured to generate a circulating flow in the container.

In another aspect of the invention, a process comprises mixing water and paper stock within a container to form a suspension and directing a flow of the suspension downwardly, offset from a centerline of the container. In embodiments, the directing a flow is along a centerline of a rotor.

In another aspect of the invention, the pulper for pulverizing and suspending paper stock comprises a container having an open top and a base, and a driven rotor located on the base of the container above a plane of a flat portion of the base. The driven rotor is also positioned such that a centerline of the rotor is offset from a centerline of the container.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
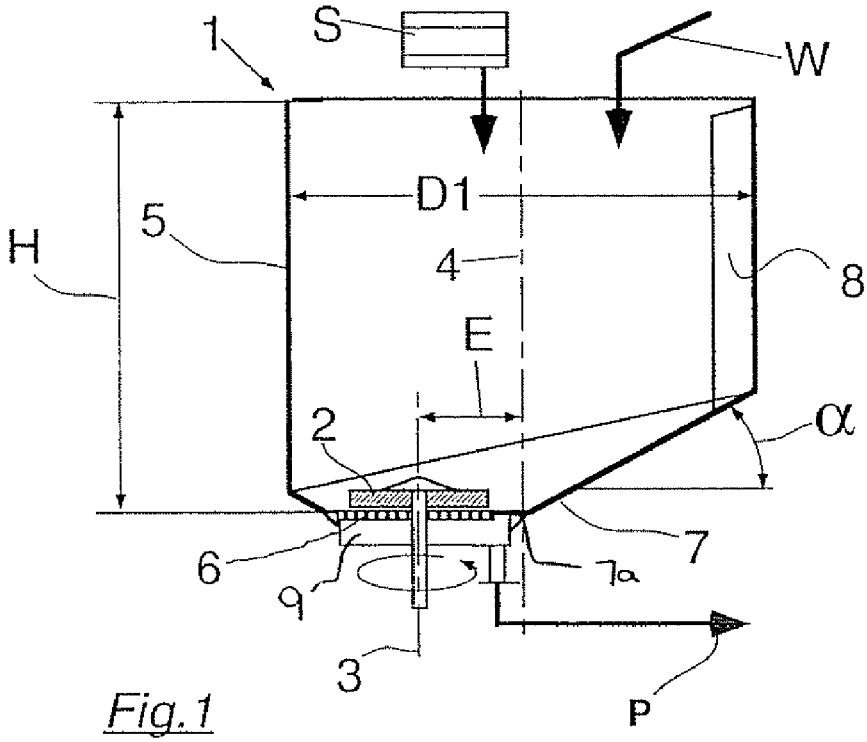
FIG. 1 shows a sectional side view of a pulper according to the invention.

FIG. 1 shows a side sectional view of the pulper in accordance with the invention. In FIG. 1, the paper stock S is fed together with water W into a container 1, which has an open top. During the operation of the pulper, the container 1 includes a mixture of water and paper stock which, in part, is already pulverized. The suspension, with coarse and fine solids, is set in rotation through the rotor 2 arranged in the base area of the container 1. The rotor 1 is driven by a motor (not shown). In accordance with the invention, the centerline 3 of the rotor 2 is arranged laterally, and is displaced (offset) with respect to the centerline 4 of the container 1. With a cylindrical container 1, the eccentricity E of this displacement is preferably as great as half the diameter D1 of the container 1, with a tolerance of about ±30%.

The suspension is drawn downward by the rotor 2, whereby a flow directed downward is formed approximately along the centerline 3 of the rotor 2. As a result of the pump effect of the rotor 2, the suspension is conveyed radially outwards on the base of the container 1 and thus reaches its side wall 5. In this manner, a circulation flow is thus formed. As is known per se, in the slushing process, the pulverization and suspension of the paper stock is effected through hydraulic forces and through contact between the rotor 2 and paper stock. Paper stock parts that are sufficiently pulverized can, as shown in FIG. 1, reach a chamber 9 through a screen plate (wire) 6 and be guided away as fibrous suspension P. Such a pulper can be operated continuously as well as intermittently. It should be understood by those of skill in the art that the screen plate 6 is not absolutely necessary. As a rule, the solids proportion in the suspension P is approximately 3 to 6%, but is not limited to such range.

The offset rotor arrangement develops its favorable effect particularly when the base 7 of the container 1, outside the screen area, has an incline. For example, the base angle $\alpha$, as shown in FIG. 1, is preferably between approximately 15° and 60°. At approximately 30°, there is a particularly favorable embodiment with respect to effect, container volume, structural expenditure and space requirements. The rotor 2 may also be positioned above a plane of a flat portion 7*a* of the base 7.

Still referring to FIG. 1, at least one flow barrier 8 is located on the inside of the side wall 5 of the container 1, which lies opposite the rotor 2. The flow barrier 8 extends in a vertical direction, within the container 1. In embodiments, there can be one or two flow barriers; although, more flow barriers are also contemplated by the invention. The flow barrier 8 can be embodied as a angle profile such as, for example, a rectangular or triangular profile, that extends vertically from the base 7 of the container 1 to above the suspension level formed during operation. The flow barrier 8 extends with a radial projection F into the container, at least 5%, and preferably at least 10%, of the diameter D1 of the container 1. The container 1 has a total height H of approximately 2000 mm.

Figure 2:
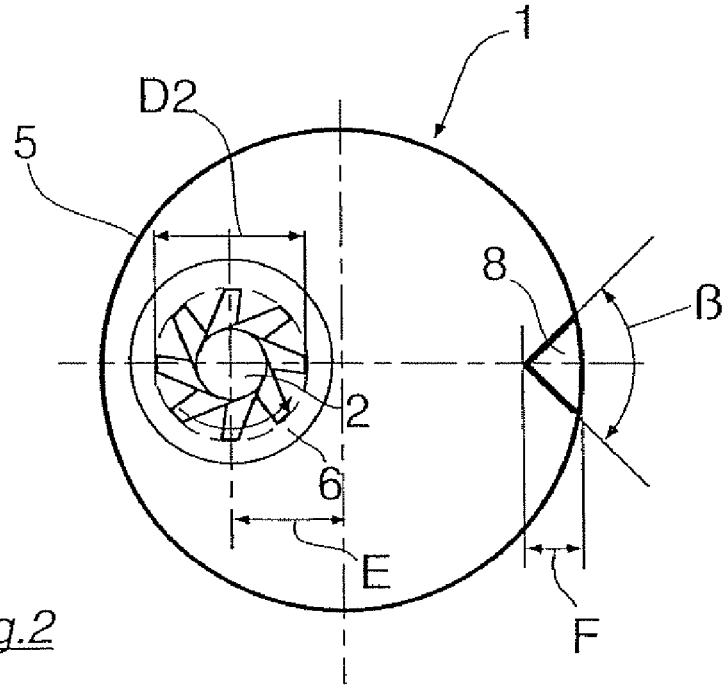
FIG. 2 shows a top view of the pulper of FIG. 1 according to the invention.

FIG. 2 shows a top view of the pulper of FIG. 1. In particular, FIG. 2 shows the eccentricity E of displacement, in addition to the radial projection F of the flow barrier 8 extending into the container 1. FIG. 2 further shows an outer diameter D2 of the rotor 2.

The pulper according to the invention can be provided, e.g., with different measurements. In embodiments, the container 1 of the pulper has a total height H of approximately 2000 mm and a diameter D1 of which is approximately 2435 mm. In embodiments, the ratio between total height and diameter of the container can be between approximately 0.8 and 1.2. The eccentricity E is about a quarter of the diameter D1, thus approximately 609 mm. The rotor 2 has an outer diameter D2 of approximately 970 mm on its moving blades, which is located (e.g., runs) closely above a flat annular wire (e.g., screen plate) 6 in the base of the container. In embodiments, the diameter of the rotor 2 is between approximately 20 and 40% of a diameter of the container 1. In embodiments, the wire 6 is arranged horizontally and concentrically with the rotor. In embodiments, the rotor 2 keeps the openings in the wire 6 free of clogs. A chamber 9 is located under the wire 6 for receiving and removing the suspension formed in the container 1.

The base 7 of the pulper is tilted at a base angle $\alpha$=30°, with the exception of the horizontal wire area. On the side of the side wall 5, furthest removed from the centerline of the rotor 2, the flow barrier 8 is mounted in the form of a rectangular angle profile that extends vertically from the base 7 up to approximately the upper edge of the container 1 and projects into the container with a radial projection F≈400 mm. In other words, in embodiments, the flow barrier 8 is located in a 180° sector of the container that is furthest removed from the rotor 2. Even though this example has proven to be a particularly favorable embodiment, other cases, in particular larger pulpers, are also conceivable with which the invention can be realized.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A pulper for pulverizing and suspending paper stock, comprising:

a cylindrical container having an open top; and a driven rotor located on a base of the container such that a centerline of the rotor is offset from a centerline of the cylindrical container, wherein the base of the container rises towards a side wall of the cylindrical container at an angle, and wherein the container is configured to mix paper stock with water, and to pulverize and suspend the paper stock so that a suspension containing paper stock is formed.

2. The pulper according to claim 1, wherein the centerline of the rotor is vertical.

3. The pulper according to claim 1, wherein the container has an essentially cylindrical side wall, the centerline of which is perpendicular to the base.

4. The pulper according to claim 3, further comprising at least one flow barrier installed on the essentially cylindrical side wall of the container.

5. The pulper according to claim 4, wherein the at least one flow barrier extends into the container with a radial projection of at least 10% of a diameter of the container.

6. The pulper according to claim 4, wherein the at least one flow barrier is located in a 180° sector of the container that is furthest removed from the rotor.

7. The pulper according to claim 4, wherein the at least one flow barrier is located at a point of the container furthest removed from the rotor.

8. The pulper according to claim 4, wherein the at least one flow barrier is only one flow barrier.

9. The pulper according to claim 4, wherein the at least one flow barrier is two flow barriers.

10. The pulper according to claim 4, wherein the at least one flow barrier comprises a vertical angle profile which has sides connected to the side wall of the container.

11. The pulper according to claim 4, wherein the at least one flow barrier extends into the container with a radial projection of at least approximately 20% of the diameter of the container.

12. The pulper according to claim 11, wherein the flow barrier is located in a 180° sector of the container that is furthest removed from the rotor.

13. The pulper according to claim 1, further comprising a flat annular wire arranged horizontally and concentrically with the rotor and located in the base of the container, and a chamber for receiving and removing the suspension formed in the container which is located under the wire.

14. The pulper according to claim 1, wherein a diameter of the rotor is between approximately 20 and 40% of a diameter of the container.

15. The pulper according to claim 1, wherein a ratio between total height and diameter of the container is between approximately 0.8 and 1.2.

16. The pulper according to claim 1, wherein, starting from an area of the rotor, the base rises towards the sidewall of the container at a base angle that is between approximately 15° and 60°.

17. The pulper according to claim 16, wherein the base angle is between approximately 25° and 35°.

18. The pulper according to claim 1, wherein the rotor is configured to generate a circulating flow in the container.

* * * * *